US009997145B1

(12) United States Patent
Rubenstein

(10) Patent No.: US 9,997,145 B1
(45) Date of Patent: Jun. 12, 2018

(54) HAMMER PICK

(71) Applicant: Paul Rubenstein, Ridgewood, NY (US)

(72) Inventor: Paul Rubenstein, Ridgewood, NY (US)

( * ) Notice: Subject to any disclaimer, the term of this patent is extended or adjusted under 35 U.S.C. 154(b) by 0 days. days.

(21) Appl. No.: 15/651,642

(22) Filed: Jul. 17, 2017

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS 398,176 A * 2/1889 Oerlein ..... G10D 3/02 84/290
490,407 A * 1/1893 Eisenbrandt ..... G10D 1/12 84/284
1,226,352 A * 5/1917 Menzenhauer ..... G10D 3/085 84/323
2,528,663 A * 11/1950 Mitchel ..... G10H 3/181 200/17 R
4,137,814 A * 2/1979 Rowley ..... G10D 3/163 84/322
4,936,181 A * 6/1990 Marron ..... G10K 1/072 116/169
5,320,019 A * 6/1994 McCaw ..... G10D 3/163 84/323
5,837,913 A * 11/1998 Newman ..... G10D 3/163 84/329
6,133,516 A 10/2000 Hendrickson
7,060,882 B2 6/2006 Greenwald
7,238,869 B1 * 7/2007 Kleckzka ..... G10D 3/163 84/320
7,825,315 B1 11/2010 King
8,097,798 B2 * 1/2012 McDonald ..... G10D 3/163 84/315
8,178,767 B1 5/2012 King
8,193,431 B1 * 6/2012 Engler ..... G10D 3/163 84/322
8,222,505 B1 * 7/2012 Bodnar ..... G10D 3/163 84/320
8,263,845 B2 * 9/2012 McDonald ..... G10D 3/163 84/315
8,962,960 B2 * 2/2015 Peil ..... G10D 3/08 84/323
2012/0125176 A1 5/2012 Engler
2013/0333543 A1 12/2013 Peil

FOREIGN PATENT DOCUMENTS

WO WO1992017877 A1 10/1992

* cited by examiner

*Primary Examiner* — Robert W Horn
(74) *Attorney, Agent, or Firm* — Werschulz Patent Law, LLC; Patricia Werschulz

(57) ABSTRACT

A hammer pick that provides a musician the ability to strum a string instrument with a pick and smoothly switch to striking the strings of the instrument with a hammer. A pick and a hammer are coupled in the device such that the musician can pluck or strike the strings by repositioning a hand holding the hammer pick. The pick is held in a pick holder that connects to the hammer by a spring and an adjustable post. The musician plucks with the pick between a thumb and index finger and slightly rotates the hand allowing the hammer to strike one or more strings to produce a different tone from the instrument.

20 Claims, 3 Drawing Sheets

HAMMER PICK

TECHNICAL FIELD

The present disclosure relates generally to a musical instrument accessory. More particularly, the present disclosure relates to a guitar pick.

BACKGROUND

Musicians have been using picks for thousands of years to play stringed musical instruments in addition to using their fingers to pluck the strings. Picks save wear and tear on the musician's fingers and also can change the tone of the note.

There are two common types of picks: fingerpicks and flat picks, also called picks or plectra. Fingerpicks clip onto or wrap around the end of the fingers and thumb.

Flat picks are isosceles triangles with rounded corners that are held between the thumb and index finger and are used to play a wide variety of stringed musical instruments such as guitar, bass guitar, some styles of banjo, mandolin, and sitar to name just a few. These picks are made in a wide variety of materials.

A few stringed instruments also produce notes by hammers hitting the strings. The two most common instruments are the piano and the hammered dulcimer. Unlike guitars and most instruments played by plucking or strumming, hammered dulcimers and pianos are not held by the musician but sit independently on a table or stand alone. Hitting the strings rather than plucking or strumming produces a very different tone.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a musician the ability to produce different tonal qualities from a string instrument. Accordingly, an aspect of an example embodiment in the present disclosure provides a device that can alternate between two methods of engaging the strings of a string instrument.

Another aspect of an example embodiment in the present disclosure is to provide a musician the ability to strum a string instrument and smoothly switch to striking the strings of a stringed instrument with a hammer. Accordingly, the present disclosure provides a device that provides a pick conjoined to a hammer such that the musician can pluck or strike the strings by repositioning a hand on the strings.

A further aspect of an example embodiment in the present disclosure is to provide a device for playing a string instrument having a pick and a hammer. Accordingly, the present disclosure provides a pick held in a pick holder that connects to the hammer by a spring and an adjustable post.

Accordingly, this disclosure describes a hammer pick that provides a musician the ability to strum a stringed instrument with a pick and smoothly switch to striking the strings of the instrument with a hammer. A pick and a hammer are connected in the device such that the musician can pluck or strike the strings by repositioning a hand holding the hammer pick. The pick is held in a pick holder that connects to the hammer by a spring and an adjustable post. The musician strums with the pick between a thumb and index finger and slightly rotates the hand allowing the hammer to strike one or more strings to produce a different tone from the instrument.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
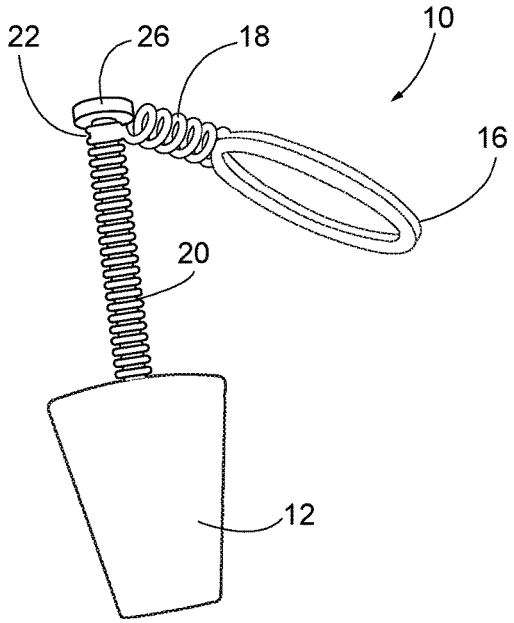
FIG. 1 is a perspective view of an example embodiment of a hammer pick.
Figure 2:
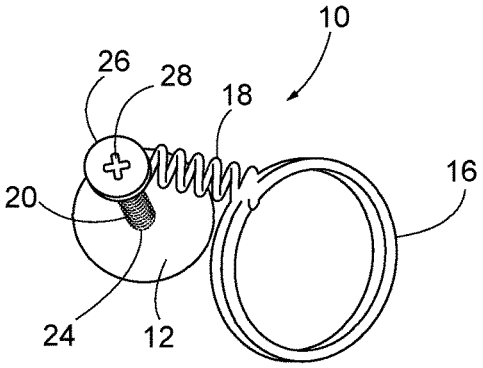
FIG. 2 is a top perspective view of the example embodiment of the hammer pick.
Figure 3:
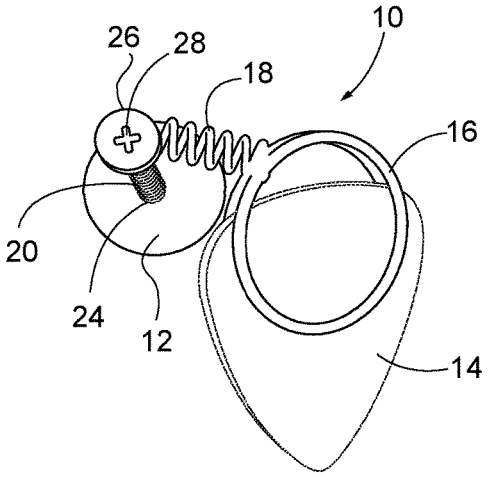
FIG. 3 is a top perspective view of the example embodiment of the hammer pick with a pick in place.

FIGS. 1-3 illustrate an example embodiment of a device for strumming and striking a stringed instrument. The device is a hammer pick 10. The device allows a musician to alternate between playing a guitar or other similar stringed instruments with a pick 14 and with a hammer 12.

In this disclosure, the term "stringed instrument" refers to a family of musical instruments, such as for example, but not limited to, guitar, bass guitar, some styles of banjo, mandolin, and sitar that are played using picks.

The hammer pick 10 has a pick holder 16 attaching to a spring 18 at a distal end of the spring 18. The spring 18 allows the hammer 12 to easily bounce, striking the strings and producing a unique sound. The musician manipulates the hammer 12 to strike one or two strings at once and adjusts the speed and force of the bounce of the hammer through wrist motions.

In the drawings, the pick holder 16 is shown as two congruent rings but this is not a limitation. The pick holder 16 can have various shapes suitable for grasping a pick 14 and maintaining the pick by tension. The shapes can be, for example but not limited to two congruent "U's" or two posts bound together with a slot between.

The hammer pick 10 has the hammer 12. The hammer 12 is interchangeable and hammers of various materials of composition, size and weight can be used in the hammer pick 10. Material of composition, size and weight are not a limitation of the hammer 12. A musician may choose the material, size and weight of the hammer 12 based on a desired musical quality and the type of stringed instrument being played. The material, size and weight of the hammer 12 effect the tonal quality of the notes produced. The musician chooses the weight of the hammer 12 for optimal bounce for the type of strings and string tension of the instrument being played.

The hammer pick 10 has an adjustable center post 20 attaching to the hammer 12. The center post has a top 26. The hammer pick 10 has a joint 22 adjacent to the top 26 of the center post 20 joining the proximal end of the spring 18 and the center post 20.

The center post 20 is preferably threaded. The hammer 12 has a threaded opening 24 and the center post 20 threads into the hammer 12. The top 26 of the center post 20 has a head 28. The top head 28 of the center post 20 is rotated to adjust the length of the center post.

Figure 4:
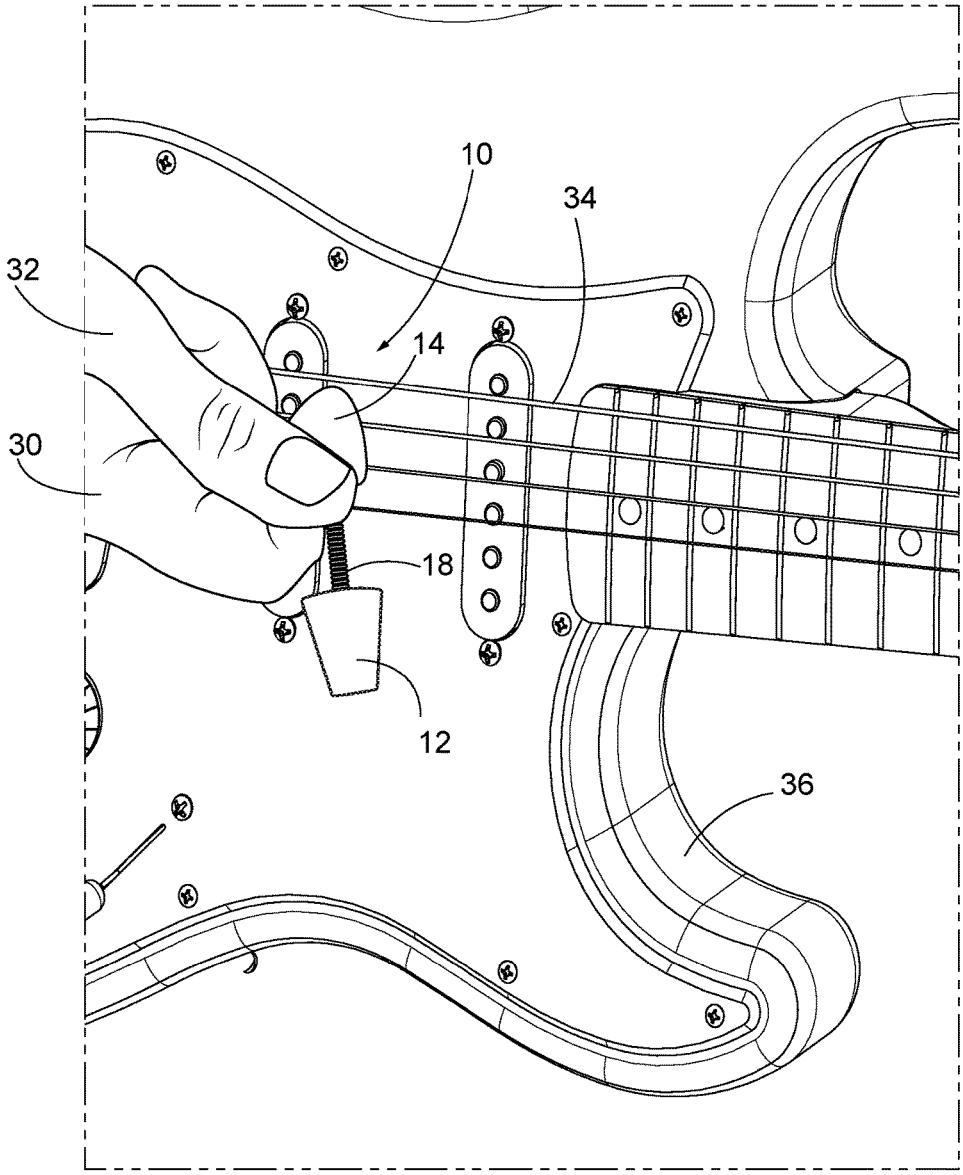
FIG. 4 is a perspective view of a musician using the pick of the example embodiment of the hammer pick to play a musical instrument.
Figure 5:
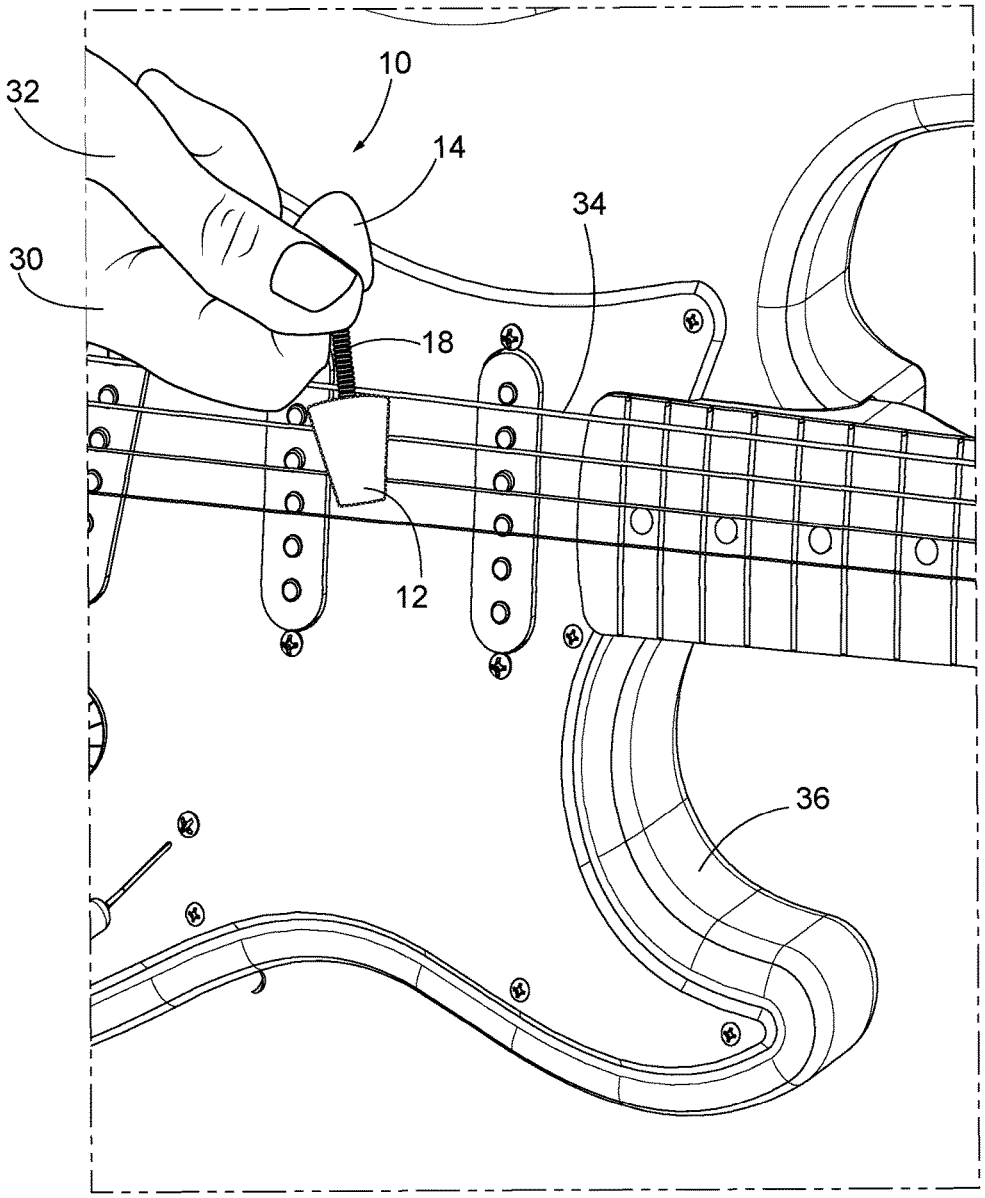
FIG. 5 is a perspective view of a musician using a hammer of the example embodiment of the hammer pick to play a musical instrument.

Referring to FIGS. 4 and 5, the pick 14 and the hammer 12 are configured to alternatively contact at least one string 34 of the stringed instrument 36.

The spring 18, shown in FIGS. 1-3 discussed hereinabove, is configured for bouncing the hammer 12 on a first string 34 of the stringed instrument 36 and simultaneously on a second string of the stringed instrument when the hammer pick 10 is held at an angle that positions the hammer appropriately.

In another example embodiment, the pick holder 16 attaches to an elastic handle 18 that connects to the post 20 of the hammer 12. The elastic handle has sufficient elasticity to allow the hammer to bounce and includes other shapes in addition to the spring 18 shown in the drawings. The action of the elastic handle, which includes a coiled elastic handle formed into a spring 18, allows a bouncing effect, so the resulting sound is similar to a hammered dulcimer In a further example embodiment which is not shown in the drawings, the hammer has a center spring threaded into opening in the hammer. The center spring attaches to a post or handle connecting to the pick holder.

FIGS. 1-5 demonstrate a method for playing a stringed instrument using a hammer pick 10.

The method of playing the stringed instrument, such as a guitar, with the hammer pick 10 is similar to playing a dulcimer, but the hammer pick 10 allows the musician to play the guitar or other similar stringed instruments 36 upright, rather than laying it flat, like a dulcimer. This configuration allows the musician to easily switch back and forth between playing with the pick 14 and playing with the hammer 12.

The musician places the pick 14 in a pick holder 16 of the hammer pick 10. The pick holder 16 coupled is to the post 20 and the spring 18. The post 20 and the spring 18 are at an approximate right angle to each other, the combined post and spring having a pair of ends, the pick holder 16 attaching to a first end and the hammer 12 attaching to the second end as described hereinabove.

The musician grasps the pick 14 in the pick holder 16 between a thumb 32 and index finger 30 of a strumming hand while holding the stringed instrument 36 in a vertical position rather than flat as a dulcimer is held.

The musician strums at least one string 34 on the stringed instrument 36 with the pick 14. The strumming hand rotates clockwise by a wrist appended to the strumming hand.

The musician seamlessly converts to striking at least one string 34 on the stringed instrument 36 with the hammer by rotating the strumming hand in a clockwise direction, allowing the hammer 12 to rotate at an angle to contact at least one string 34. Depending on the angle of rotation, the hammer 12 can strike two strings simultaneously. The rotation of the wrist determines speed and force of the hammer 12 when the hammer strikes at least one string 34.

Strumming the strings 34 alternates with striking the strings in a smooth and seamless manner while the musician continuously holds the hammer pick 10 in the strumming hand.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a hammer pick. The disclosure is illustrated by example in the drawing figures, and throughout the written description. It should be understood that numerous variations are possible, while adhering to the inventive concept. Such variations are contemplated as being a part of the present disclosure.

What is claimed is:

1. A hammer pick for playing a stringed instrument, comprising:

a pick holder attaching to a spring at a distal end of said spring;

a hammer;

an adjustable center post attaching to the hammer, the center post having a top; and a joint adjacent to the top of the center post joining the proximal end of said spring and the center post.

2. The hammer pick as described in claim 1, wherein the center post is threaded.

3. The hammer pick as described in claim 1, wherein the center post has a top head.

4. The hammer pick as described in claim 1, wherein the top head of the center post is rotated to adjust the length of the center post.

5. The hammer pick as described in claim 1, wherein one hammer is interchangeable with another hammer of a different material of composition, a different size and a different weight for producing different tones.

6. The hammer pick as described in claim 1, further comprising a pick for placing in the pick holder wherein the pick in the pick holder and the hammer are configured to alternatively contact at least one string of the stringed instrument.

7. The hammer pick as described in claim 1, wherein the spring is configured for bouncing the hammer on a first string of the stringed instrument and simultaneously on a second string of the stringed instrument when the hammer pick is held at an angle that positions the hammer appropriately.

8. The hammer pick as described in claim 7, wherein the hammer end is weighted for optimal bounce on the at least one string of the stringed instrument.

9. The hammer pick as described in claim 1, wherein the pick is held in the pick holder by tension.

10. A hammer pick for playing a stringed instrument, comprising:

a pick holder;

a hammer; and a post coupling to an elastic handle at an approximate right angle, the combined post and handle having a pair of ends, the pick holder attaching to a first end and the hammer attaching to the second end.

11. The hammer pick as described in claim 10, wherein one hammer is interchangeable with another hammer of a different material for producing different tones.

12. The hammer pick as described in claim 10, further comprises a pick for placing in the pick holder wherein the pick in the pick holder and the hammer are configured to alternatively contact at least one string of the stringed instrument.

13. The hammer pick as described in claim 10, wherein the elastic handle is a spring configured for bouncing the hammer on a first string of the stringed instrument and simultaneously on a second string of the stringed instrument when the hammer pick is held at an angle that positions the hammer appropriately.

14. The hammer pick as described in claim 13, wherein the hammer end is weighted for optimal bounce on the at least one string of the stringed instrument.

15. The hammer pick as described in claim 10, wherein the pick is held in the pick holder by tension.

16. A method for playing a stringed instrument using a hammer pick, comprising:

placing a pick in a pick holder of a hammer pick, the pick holder coupled to a post and a spring, the post and spring at an approximate right angle to each other, the combined post and spring having a pair of ends, the pick holder attaching to a first end and a hammer attaching to the second end;

grasping the pick in the pick holder between a thumb and index finger of a strumming hand while holding a stringed instrument in a vertical position;

strumming at least one string on the stringed instrument with the pick; and striking the at least one string on the stringed instrument with the hammer by rotating the strumming hand in a clockwise direction, allowing the hammer to rotate at an angle to contact the at least one string.

17. The method as described in claim 16, wherein the hammer strikes two strings simultaneously.

18. The method as described in claim 17, wherein the strumming hand is rotated clockwise by a wrist appended to the strumming hand.

19. The method as described in claim 18, wherein the rotation of the wrist determines speed and force of the hammer when the hammer strikes the at least one string.

20. The method as described in claim 19, wherein the step of strumming the at least one string alternates with the step of striking the at least one string in a smooth and seamless manner while continuously holding the hammer pick in the strumming hand.

* * * * *